US008142906B2

(12) United States Patent
Taira et al.

(10) Patent No.: US 8,142,906 B2
(45) Date of Patent: Mar. 27, 2012

(54) SN-PLATED COPPER OR SN-PLATED COPPER ALLOY HAVING EXCELLENT HEAT RESISTANCE AND MANUFACTURING METHOD THEREOF

(75) Inventors: Kouichi Taira, Shimonoseki (JP); Yasushi Masago, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 196 days.

(21) Appl. No.: 12/712,494

(22) Filed: Feb. 25, 2010

(65) Prior Publication Data

US 2010/0247959 A1 Sep. 30, 2010

(30) Foreign Application Priority Data

Mar. 26, 2009 (JP) ..... 2009-076853

(51) Int. Cl.

| | |
|---|---|
| ***B32B 15/20*** | (2006.01) |
| ***C25D 5/50*** | (2006.01) |
| ***C25D 5/12*** | (2006.01) |
| ***C25D 7/00*** | (2006.01) |
| ***H01R 13/03*** | (2006.01) |

(52) U.S. Cl. ..... 428/647; 428/648; 428/675; 428/929; 439/886; 205/226; 205/228; 148/518

(58) Field of Classification Search ..... None
See application file for complete search history.

(56) References Cited

U.S. PATENT DOCUMENTS

| | | | | |
|---|---|---|---|---|
| 6,759,142 | B2 | 7/2004 | Hara et al. | |
| 7,700,883 | B2 * | 4/2010 | Masago et al. | 174/126.2 |
| 7,871,710 | B2 * | 1/2011 | Masago et al. | 428/647 |
| 2005/0037229 | A1 * | 2/2005 | Tanaka | 428/647 |
| 2005/0106408 | A1 * | 5/2005 | Chen et al. | 428/629 |
| 2008/0257581 | A1 | 10/2008 | Masago et al. | |
| 2009/0053553 | A1 | 2/2009 | Masago et al. | |
| 2009/0130480 | A1 * | 5/2009 | Hatano | 428/647 |
| 2010/0175908 | A1 * | 7/2010 | Okamoto et al. | 174/126.2 |

(Continued)

FOREIGN PATENT DOCUMENTS

| | | | |
|---|---|---|---|
| CN | 1985333 | A | 6/2007 |

(Continued)

OTHER PUBLICATIONS

Machine translation of JP 11-343594. Dec. 1999.*

(Continued)

*Primary Examiner* — John J Zimmerman
(74) *Attorney, Agent, or Firm* — Oblon, Spivak, McClelland, Maier & Neustadt, L.L.P.

(57) ABSTRACT

In Sn-plated copper or a Sn-plated copper alloy according to the present invention, a surface plating layer including a Ni layer, a Cu—Sn alloy layer, and a Sn layer which are deposited in this order is formed on a surface of a base material made of copper or a copper alloy. An average thickness of the Ni layer is 0.1 to 1.0 μm, an average thickness of the Cu—Sn alloy layer is 0.55 to 1.0 μm, and an average thickness of the Sn layer is 0.2 to 1.0 μm. The Cu—Sn alloy layer includes Cu—Sn alloy layers having two compositions, a portion thereof in contact with the Ni layer is formed of an ϵ-phase having an average thickness of 0.5 to 0.95 μm, and a portion thereof in contact with the Sn layer is formed of a η-phase having an average thickness of 0.05 to 0.2 μm.

6 Claims, 1 Drawing Sheet

U.S. PATENT DOCUMENTS

| | | | | |
|---|---|---|---|---|
| 2010/0266863 | A1* | 10/2010 | Tanaka | 428/555 |
| 2011/0236712 | A1 | 9/2011 | Masago et al. | |
| 2011/0266035 | A1* | 11/2011 | Sakurai et al. | 174/255 |

FOREIGN PATENT DOCUMENTS

| | | | |
|---|---|---|---|
| EP | 1 788 585 | A1 | 5/2007 |
| JP | 11-343594 | | 12/1999 |
| JP | 2004-68026 | | 3/2004 |
| JP | 2006-77307 | | 3/2006 |
| JP | 4319247 | | 6/2009 |

OTHER PUBLICATIONS

Office Action issued Jun. 21, 2011, in Chinese Patent Application No. 201010143378.9 with English translation.

* cited by examiner

SN-PLATED COPPER OR SN-PLATED COPPER ALLOY HAVING EXCELLENT HEAT RESISTANCE AND MANUFACTURING METHOD THEREOF

FIELD OF THE INVENTION

The present invention relates to Sn-plated copper or a Sn-plated copper alloy used in a conductive material for connection parts such as a terminal, a connector, and a junction block that are used mainly for automobiles, and a manufacturing method thereof.

BACKGROUND OF THE INVENTION

Conventionally, a Sn-plated (reflow Sn-plated or bright Sn-electroplated) copper alloy has been used in in-vehicle connectors or the like.

In recent years, in response to demand for space savings in a vehicle cabin, a place where connectors are disposed has been progressively shifted from the inside of the cabin to the inside of an engine room. It is said that the temperature of an atmosphere inside the engine room becomes about 150° C. or higher than that. Accordingly, in a conventional Sn-plated material, Cu and an alloy element from a copper or copper alloy base material are diffused in a surface thereof to form a thick oxide coating in the surface layer of Sn plating, and increase the contact resistance of a terminal contact portion. This causes concerns about heat generation from an electronic control device and an electric current disorder therein.

As a technique for improving the situation, a method has been developed which provides a Ni layer and a Cu—Sn alloy layer between the base material and a Sn plating layer, and thereby prevents the diffusion of Cu from the base material (see Patent Documents 1 and 2). The method allows a low contact resistance value to be maintained at a terminal contact portion even after long-time heating at 150° C. However, the use of the method in a temperature range in excess of 150° C. is avoided.

When heating is performed for a long time at a temperature in excess of 150° C., the speed of Ni diffusion increases and, even in the Sn-plated copper alloy of JP-2004-68026 A and JP-2006-77307 A, Ni is diffused from the valley of the Cu—Sn alloy layer or an extremely thin portion thereof into the Sn layer to form a Ni—Sn intermetallic compound or a Ni oxide in the surface layer of Sn plating, increases a contact resistance value, and causes heat generation and an electric current disorder in the same manner as in the conventional Sn-plated material. As a result, it may be difficult to maintain electric reliability. Accordingly, a plated material has been required in which an increase in contact resistance value and plating separation do not occur even after long-time heating at 180° C.

SUMMARY OF THE INVENTION

The present invention has been achieved in view of the problems described above, and an object of the present invention is to provide, in association with Sn-plated copper or a Sn-plated copper alloy material in which a surface plating layer including a Ni layer, a Cu—Sn alloy layer, and a Sn layer which are deposited in this order is formed on a surface of a base material made of copper or a copper alloy, Sn-plated copper or a Sn-plated copper alloy having excellent heat resistance even after being exposed to a temperature environment at 180° C.

Sn-plated copper or a Sn-plated copper alloy according to the present invention is Sn-plated copper or a Sn-plate alloy including a base material made of copper or a copper alloy, and a surface plating layer including a Ni layer, a Cu—Sn alloy layer, and a Sn layer which are formed in this order on a surface of the base material. Here, an average thickness of the Ni layer is 0.1 to 1.0 μm, an average thickness of the Cu—Sn alloy layer is 0.55 to 1.0 μm, and an average thickness of the Sn layer is 0.2 to 1.0 μm. The Cu—Sn alloy layer includes Cu—Sn alloy layers having two compositions. In said two types of Cu—Sn alloy layers, a portion in contact with the Sn layer is formed of a η-phase having an average thickness of 0.05 to 0.2 μm, and a portion in contact with the Ni layer is formed of an ϵ-phase having an average thickness of 0.5 μm to 0.95 μm.

In the Sn-plated copper or Sn-plated copper alloy described above, a ratio between the respective average thicknesses of the Cu—Sn alloy layer formed of said s—phase and the Cu—Sn alloy layer formed of said η-phase is preferably 3:1 to 7:1.

In the Sn-plated copper or Sn-plated copper alloy described above, a part of said η-phase is preferably exposed at a surface thereof, and a ratio of a surface exposure area of said η-phase is preferably 20 to 50%.

In the Sn-plated copper or Sn-plated copper alloy described above, a ratio among the respective average thicknesses of said Sn layer, the Cu—Sn alloy layer formed of said η-phase, and the Cu—Sn alloy layer formed of said ϵ-phase is preferably 2x to 4x:x:2x to 6x.

A manufacturing method of the Sn-plated copper or Sn-plated copper alloy according to the present invention includes the steps of forming, on the surface of the base material made of the Cu or Cu alloy, a Ni plating layer having an average thickness of 0.1 to 1.0 μm, a Cu—Sn alloy plating layer having an average thickness of 0.4 to 1.0 μm, and a Sn plating layer having an average thickness of 0.6 to 1.0 μm in this order in a direction away from said base material each by electroplating, and then performing a reflow treatment for the Sn plating layer.

In the manufacturing method of the Sn-plated copper or Sn-plated copper alloy described above, a Cu plating layer having an average thickness of 0.1 to 0.5 μm may be formed between said Cu—Sn alloy plating layer and said Sn plating layer by electroplating.

According to the present invention, there can be obtained the Sn-plated copper or Sn-plated copper alloy having excellent heat resistance in which the two types of Cu—Sn alloy layers serve as diffusion prevention layers to inhibit the diffusion of Cu and Ni, and can prevent an increase in contact resistance value and plating separation even in a high-temperature environment (at 180° C. for 1000 hours).

DETAILED DESCRIPTION OF THE PREFERRED EMBODIMENTS

Figure 1A:
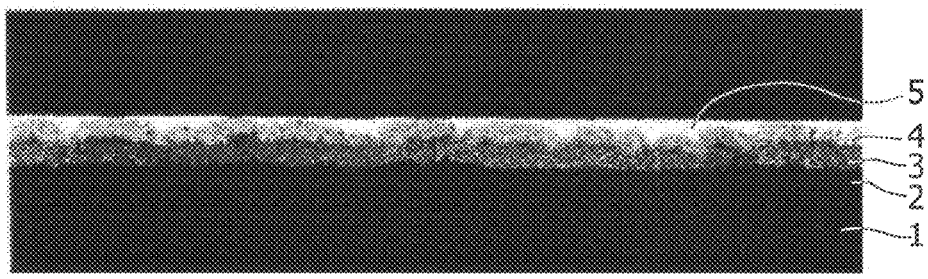
FIG. 1A is a SEM microstructure photograph of a Sn-plated copper alloy according to the present invention.

Subsequently, a configuration of a surface plating layer of Sn-plated copper or a Sn-plated copper alloy and a manufacturing method thereof according to the present invention will be described in succession.

<Surface Plating Layer>

(Ni Layer)

Of the surface plating layer, a Ni layer is deposited in order to inhibit diffusion from a base material made of copper or a copper alloy into a Sn layer, and improve heat resistance in a high-temperature environment. If the average thickness of the Ni layer is less than 0.1 μm, the effect of inhibiting the diffusion of Cu from the base material is low, and a Cu oxide is formed in the surface of a Sn plating layer to cause an increase in contact resistance so that the Ni layer does not satisfy the intrinsic function thereof. On the other hand, if the average thickness of the Ni layer exceeds 1.0 μm, formability into a terminal deteriorates, resulting in the occurrence of a crack in bending or the like. Accordingly, the average thickness of the Ni layer is adjusted to be 0.1 to 1.0 μm, or preferably 0.1 to 0.6 μm.

In the present configuration, if the Ni layer is not present, interdiffusion of Cu and Sn occurs between an ϵ-phase ($Cu_3Sn$) and the base material to form, at the interface therebetween, a Kirkendall void which causes separation.

(Cu—Sn Alloy Layer)

Of the surface plating layer, the Cu—Sn alloy layer is deposited in order to inhibit not only the diffusion of Cu from the base material even after long-time heating at 180° C., but also the diffusion of Ni from the Ni layer into the Cu—Sn alloy layer, and further into the Sn layer. If the average thickness of the Cu—Sn alloy layer is not more than 0.55 μm, the diffusion from the Ni layer in a high-temperature environment cannot be inhibited, and the diffusion of Ni into the surface of Sn plating proceeds so that the Ni layer is destroyed, and Cu of the base material is further diffused from the destroyed Ni layer into the surface of the Sn plating to cause an increase in contact resistance value, and separation due to the weakening of the plating interface. On the other hand, if the average thickness of the Cu—Sn alloy layer exceeds 1.0 μm, formability into a terminal deteriorates, resulting in the occurrence of a crack in bending or the like. Accordingly, the thickness of the Cu—Sn alloy layer is adjusted to be 0.55 to 1.0 μm, or preferably 0.6 to 0.8 μm.

The Cu—Sn alloy layer includes two layers of Cu and Sn at different ratios. The layer in contact with the Ni layer is formed of the ϵ-phase ($Cu_3Sn$), while the layer in contact with the Sn layer is the Cu—Sn alloy layer formed of a η-phase ($Cu_6Sn_5$). Of the two layers, the ϵ-phase layer in contact with the Ni layer is considered to primarily have the function of inhibiting the diffusion of Ni so that the average thickness of the ϵ-phase layer is adjusted to be more than 0.5 μm. On the other hand, if the average thickness of the ϵ-phase layer exceeds 0.95 μm, bendability deteriorates. Accordingly, the average thickness of the ϵ-phase layer is adjusted to be more than 0.5 μm and not more than 0.95 μm, or preferably more than 0.5 μm and not more than 0.7 μm. The η-phase is generated simultaneously with the ϵ-phase, and the average thickness of the η-phase layer is 0.05 to 0.2 μm on condition that the average total thickness of the Cu—Sn alloy layers after a reflow treatment is within the range of 0.5 to 1.0 μm. When the configuration of the ϵ-phase layer is non-uniform and an extremely thin portion exists, the function of inhibiting the diffusion of Ni in the portion is insufficient so that even the thinnest portion of the ϵ-phase layer preferably has a thickness of 0.3 μm or more. Since the ϵ-phase layer is the Cu—Sn alloy layer having a high Cu ratio, it is effective in preventing Cu diffusion not only from the underlying Ni layer, but also from the base material.

(Sn Layer)

The Sn layer is deposited in order to maintain the contact resistance of a terminal low to increase electric reliability, and ensure solder wettability. If the average thickness of the Sn layer is less than 0.2 μm, the function described above is not obtainable. On the other hand, if the average thickness of the Sn layer exceeds 1.0 μm, there is an excess of Sn relative to the ratios at which Cu and Sn are consumed to form the alloy layer in a high-temperature environment in excess of 180° C. As a result, the diffusion of Ni is accelerated to lead to an increase in contact resistance value. In addition, if Sn on the surface is thick, a friction coefficient increases. Therefore, the average thickness of the Sn layer is adjusted to be 0.2 to 1.0 μm, or preferably 0.3 to 0.6 μm.

(Ratio of Surface Exposure Area of η-Phase)

In the present invention, the η-phase is exposed at the surface of the Sn plating layer formed as the outermost surface. The η-phase exposed at the surface allows an insertion force when the terminal is fitted to be reduced more greatly than at the surface typically covered only with the Sn plating layer. This is because since, in Sn-to-Sn contact, sliding resistance due to the adhesion of Sn is extremely high, if the η-phase harder than Sn is exposed at the surface, the sliding resistance can be reduced to allow a significant reduction in friction coefficient. If the ratio of the surface exposure area of the η-phase is less than 20%, the effect of reducing the friction coefficient is low. If the ratio of the surface exposure area of the η-phase exceeds 50%, galvanic corrosion occurs due to the potential difference between the Cu—Sn alloy layer and the Sn layer, and Sn performing the function of sacrificial protection is reduced, which leads to the degradation of corrosion resistance and the deterioration of solder wettability. Therefore, the ratio of the surface exposure area of the η-phase is adjusted to be 0 to 50%, and a preferable range thereof is 20 to 50%.

(Optimum Layer Configuration)

In the configuration of the present invention, the thickness of the Cu—Sn alloy layer is increased to prevent the diffusion of Cu and Ni from the Cu base material and the underlying Ni layer into the surface layer. If the ratio among the respective average thicknesses of the Sn layer, the Cu—Sn alloy layer (η-phase), and the Cu—Sn alloy layer (ϵ-phase) is 2x to 4x:x:2x to 6x, the configuration after heating becomes such that the η-phase is in the outermost layer, the Ni layer is in the second outermost layer, and the Cu base material is in the third outermost layer, and discoloration resulting from the growth of a Cu oxide coating and an increase in contact resistance value do not occur. After the heating, if the Cu/Sn weight ratio in the layer over the Ni layer approaches that in the η-phase, diffusion does not proceed any further, and excellent electrical reliability can be maintained mainly composed of SnO in the outermost layer. On the other hand, if the ϵ-phase is formed in a large amount after the heating, CuO is preferentially generated and grown in the surface layer to lead to the deterioration of electrical reliability.

(Manufacturing Method)

The Sn-plated copper or Sn-plated copper alloy according to the present invention can be manufactured by forming a Ni plating layer, a Cu—Sn alloy plating layer, and a Sn plating layer on the copper or copper alloy base material in this order each by electroplating, and subsequently performing a heat treatment. As the heat treatment, a reflow treatment for the Sn plating layer is appropriate. By the heating treatment, from the Cu—Sn alloy plating layer which is unstable in a state immediately after electrolysis and from a part of the Sn plating layer, the Cu—Sn alloy layer including more stable two layers (ϵ-phase and η-phase) is generated. The Cu—Sn alloy plating layer formed by heating and electrolysis basically forms the ϵ-phase, but an excess of Cu is diffused into the Sn layer, and consequently also forms the η-phase to provide the two Cu—Sn alloy layers.

Alternatively, it is also possible to form the Ni plating layer, the Cu—Sn alloy plating layer, a Cu plating layer, and the Sn plating layer in this order each by electroplating. By interposing the Cu plating layer between the Cu—Sn alloy plating layer and the Sn plating layer, Cu is diffused from the Cu—Sn alloy plating layer which is unstable in the state immediately after electrolysis into the Sn plating layer in the heating treatment to prevent the formation of a non-uniform Cu—Sn alloy layer.

Figure 1B:
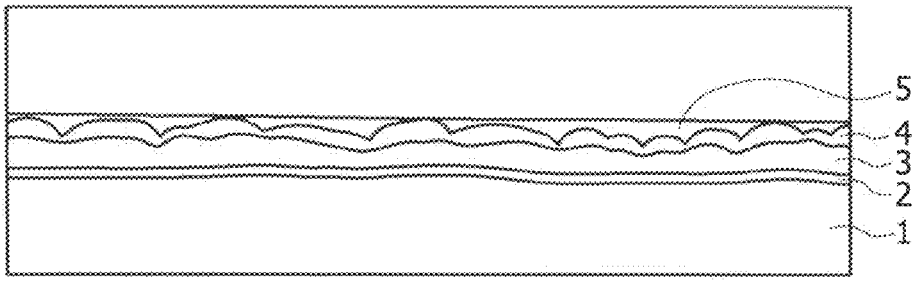
FIG. 1B is an illustrative view showing the boundaries between the individual layers in the photograph.

FIG. 1A is a SEM photograph of the surface plating layer (after the reflow treatment) formed on the base material, and FIG. 1B is an illustrative view showing the boundaries between the individual layers in the photograph. The surface plating layer on a base material 1 includes a Ni layer 2, two types of (double-layer) Cu—Sn alloy layers 3 and 4, and a Sn Layer 5. In this example, the Cu—Sn alloy layer 4 (in contact with the Sn layer) is formed of the η-phase ($Cu_6Sn_5$), while the Cu—Sn alloy layer 3 (in contact with the Ni layer) is formed of the ϵ-phase ($Cu_3Sn$). The boundary between the two layers can be clearly recognized in the SEM microstructure photograph.

The initial plating configuration (the Ni plating layer, the Cu—Sn alloy plating layer, the Cu plating layer, and the Sn plating layer) immediately after electrolysis may be formed appropriately such that the respective average thicknesses of the foregoing plating layers are 0.1 to 1.0 μm, 0.5 to 1.0 μm, 0.05 to 0.15 μm, and 0.2 to 1.0 μm.

Ni plating may be performed appropriately using a Watts bath or a sulfamate bath at a plating temperature of 40 to 60° C. and a current density of 3 to 20 A/dm$^2$. Cu—Sn alloy plating may be performed appropriately using a cyanide bath or a sulfonate bath at a plating temperature of 50 to 60° C. and a current density of 1 to 5 A/dm$^2$. Cu plating may be performed appropriately using a cyanide bath at a plating temperature of 50 to 60° C. and a current density of 1 to 5 A/dm$^2$. Sn plating may be performed appropriately using a sulfate bath at a plating temperature of 30 to 40° C. and a current density of 3 to 10 A/dm$^2$.

By forming the Cu layer and the Sn layer over the Ni layer, and performing a heat treatment to allow Cu to be diffused into the Sn layer, the Cu—Sn alloy layer (formed mainly of the η-phase) can be formed. However, since it is necessary to strictly control the respective thicknesses of the Cu layer and the Sn layer and conditions for the reflow treatment, it is difficult to control the thickness of the Cu—Sn alloy layer and effect control for allowing the ϵ-phase and the η-phase to be formed at an appropriate ratio after the reflow treatment. As a result, the thickness of the Cu—Sn alloy layer formed through the diffusion of Cu into the grain boundaries of Sn plating grains becomes non-uniform, and a problem occurs that the diffusion of Ni into the Sn layer cannot be inhibited in an extremely thin portion. By contrast, as long as the Cu—Sn alloy plating layer is formed by electrolysis, it is easy to control the thickness of the Cu—Sn alloy layer and the layer configuration after the reflow treatment, and easily form the Cu—Sn alloy layer having a uniform thickness. Therefore, it is possible to provide the ϵ-phase which prevents the diffusion of Ni with a uniform thickness, and prevent local formation of an extremely thin portion. Note that, in the Cu—Sn alloy layer formed from the Cu layer and the Sn layer by the heat treatment, clearly divided two types of (double-layer) Cu—Sn alloy layers have not been recognized.

In the present embodiment, as the copper or copper alloy base material, a base material having typical surface roughness (small surface roughness) can be used. However, it is also possible to use a base material having surface roughness larger than typical surface roughness (having minute depressions and projections formed in a surface thereof) as necessary. In this case, apart of the Cu—Sn alloy layer may be exposed at the surface by the reflow treatment. A fitting-type terminal using this material has a reduced insertion force.

EXAMPLES

<Conditions for Producing Materials Under Test>

Using plate materials of C2600 each having a thickness of 0.25 mm as copper alloy base materials, Ni plating, Cu—Sn alloy plating, Cu plating, and Sn plating were deposited to respective predetermined thicknesses using the plating baths and under the plating conditions shown in Tables 1 to 4. For the measurement of the thickness of each of the plating layers, a cross section of each of the plate materials processed by a microtome method was observed with a SEM, and the average thickness thereof was calculated by image analysis. The average thickness of each of the plating layers can be controlled by a current density and an electrolysis period. The average thickness of each of the plating layers is shown in the column of Initial Plating Configuration of Table 5.

TABLE 1

| | Concentration |
|---|---|
| Compositions of Ni Plating Bath | |
| $NiSO_4 \cdot 6H_2O$ (Nickel Sulfate) | 240 g/l |
| $NiCl_2 \cdot 6H_2O$ (Nickel Chloride) | 45 g/l |
| $H_3BO_3$ (Boric Acid) | 30 g/l |
| Ni Plating Conditions | |
| Current Density | 5 A/dm$^2$ |
| Temperature | 60° C. |

TABLE 2

| | Concentration |
|---|---|
| Compositions of Cu—Sn Alloy Plating Bath | |
| Metallic Copper | 12 g/l |
| Metallic Tin | 20 g/l |
| Free Potassium Cyanide | 50 g/l |
| Cu—Sn Alloy Plating Conditions | |
| Current Density | 5 A/dm$^2$ |
| Temperature | 60° C. |

TABLE 3

| | Concentration |
|---|---|
| Compositions of Cu Plating Bath | |
| Copper Cyanide | 40 g/l |
| Potassium Cyanide | 90 g/l |
| Cu Plating Conditions | |
| Current Density | 5 A/dm$^2$ |
| Temperature | 60° C. |

TABLE 4

| | Concentration |
|---|---|
| Compositions of Sn Plating Bath | |
| Stannous Sulfate | 80 g/l |
| Sulfuric Acid | 100 g/l |
| Additive | 15 ml/l |
| Sn Plating Conditions | |
| Current Density | 8 A/dm$^2$ |
| Temperature | 35° C. |

Subsequently, to each of the plate materials, a 10-second reflow treatment was performed at an atmospheric temperature of 280° C. The average thickness of each of the layers forming the surface plating layer after the reflow treatment is shown in the column of Post-Reflow Plating Configuration of Table 5. Note that the average thickness of each of the layers was measured in accordance with the following procedure, and the compositions of two types of Cu—Sn alloy layers were recognized in accordance with the following procedure.

(Measurement of Thicknesses of Sn Layer and Ni Layer)

Measurement was performed using a fluorescent X-ray film thickness meter (Model Code SFT-156A commercially available from Seiko Instruments & Electronics, Ltd.).

(Measurement of Thickness of Cu—Sn Alloy Layer)

A cross section of each of the plate materials processed by the microtome method was observed with a SEM, and the average thickness thereof was calculated by an image analysis process. In specimens of Nos. 1 to 4 and 6 to 9, a portion where the thickness of the ϵ-phase was less than 0.3 μm was not found.

(Recognition of Compositions of Cu—Sn Alloy Layers)

A Cu content ratio and a Sn content ratio (wt % and at %) in each of the two types of Cu—Sn alloy layers was measured by energy dispersive X-ray spectrometry (EDX), and phase identification was performed. Of the two types of layers, the layer in contact with the Ni layer was formed of an ϵ-phase, and the layer in contact with the Sn layer was formed of a η-phase. In a method which does not involve EDX analysis, the phase can also be determined based on the tone of the color of the phase in a SEM compositional image.

(Surface Exposure Ratio of Cu—Sn Alloy Layer)

The surface of each of materials under test was observed using a scanning electron microscope (SEM) of 50 magnifications having an energy dispersive X-ray spectrometer (EDX) mounted thereon. From the tone (except for the contrast of contamination or a flaw) of a compositional image obtained, the ratio of the exposure area of a Cu—Sn alloy coating layer was measured.

TABLE 5

| | Initial Plating Configuration (μm) | | | | Post-Reflow Plating Configuration (μm) | | | | | | | |
|---|---|---|---|---|---|---|---|---|---|---|---|---|
| | | | | | Sn Layer | Cu—Sn Alloy Layer (1) η-Phase | Cu—Sn Alloy Layer (2) ϵ-Phase | total Cu—Sn | (1)/(2) | Exposure Ratio of Cu—Sn Alloy Layer | Ni Layer | Sn/η/ϵ |
| | Sn | Cu | Cu—Sn | Ni | | | | | | | | |
| Example 1 | 0.5 | 0.1 | 0.9 | 0.3 | 0.4 | 0.2 | 0.8 | 1 | 1/3.3 | 0 | 0.3 | 2/1/4 |
| Example 2 | 0.9 | 0.1 | 0.9 | 0.3 | 0.7 | 0.2 | 0.8 | 1 | 1/4 | 0 | 0.3 | 3.5/1/4 |
| Example 3 | 0.3 | 0 | 0.6 | 0.3 | 0.1 | 0.1 | 0.5 | 0.6 | 1/5 | 25 | 0.3 | 1/1/5 |
| Example 4 | 0.4 | 0.05 | 1 | 0.3 | 0.2 | 0.15 | 0.8 | 0.95 | 1/5.3 | 10 | 0.3 | 1.25/1/5.3 |
| Example 5 | 0.6 | 0.1 | 0.7 | 0.3 | 0.4 | 0.2 | 0.6 | 0.8 | 1/3 | 0 | 0.3 | 2/1/3 |
| Comparative example 1 | 0.3 | 0.05 | 0.9 | 0.3 | 0.1 | 0.15 | 0.8 | 0.95 | 1/5.3 | 45 | 0.3 | 0.6/1/5.3 |
| Comparative example 2 | 1.3 | 0.05 | 0.9 | 0.3 | 1.1 | 0.15 | 0.8 | 0.95 | 1/5.3 | 0 | 0.3 | 7.3/1/5.3 |
| Comparative example 3 | 0.6 | 0.1 | 0.5 | 0.3 | 0.4 | 0.2 | 0.4 | 0.6 | 1/2 | 0 | 0.3 | 2/1/2 |
| Comparative example 4 | 0.5 | 0.1 | 0.5 | 0.3 | 0.4 | 0.2 | 1 | 1.2 | 1/5 | 0 | 0.3 | 2/1/5 |
| Comparative example 5 | 0.3 | 0 | 0.9 | 0.3 | 0.4 | 0.1 | 0.8 | 0.9 | 1/8 | 0 | 0.3 | 4/1/2 |
| Comparative example 6 | 0.6 | 0.1 | 0.5 | 0.3 | 0.4 | 0.2 | 0.4 | 0.6 | 1/2 | 0 | 0.3 | 2/1/2 |
| Comparative example 7 | 0.6 | 0.1 | 0.8 | 1.1 | 0.4 | 0.2 | 0.6 | 0.8 | 1/3 | 0 | 1.1 | 2/1/3 |
| Comparative example 8 | 0.6 | 0.1 | 0.8 | 0.05 | 0.4 | 0.2 | 0.6 | 0.8 | 1/3 | 0 | 0.05 | 2/1/3 |
| Conventional example 1 | 1.2 | 0.2 | 0 | 0 | 0.9 | 0.4 | 0.1 | 0.5 | | | 0 | |
| Conventional example 2 | 0.6 | 0.15 | 0 | 0.3 | 0.2 | 0.3 | 0 | 0.3 | | | 0.3 | |

| | Friction Coefficient | Post-Heating Contact Resistance Value | Post-Heating Separation | Other Degraded Properties |
|---|---|---|---|---|
| Example 1 | 0.52 | 2.5 | Absent | |
| Example 2 | 0.57 | 6.5 | Absent | |
| Example 3 | 0.43 | 3.2 | Absent | |
| Example 4 | 0.5 | 5.5 | Absent | |
| Example 5 | 0.55 | 3.1 | Absent | |
| Comparative example 1 | 0.4 | 3.8 | Absent | Degraded Corrosion Resistance/Solder Wettability |
| Comparative example 2 | 0.62 | 8.5 | Absent | Increased Friction Coefficient |

TABLE 5-continued

| | | | | |
|---|---|---|---|---|
| Comparative example 3 | 0.59 | 14 | Absent | Increased Contact Resistance Value |
| Comparative example 4 | 0.5 | 7.1 | Absent | Degraded Bendability |
| Comparative example 5 | 0.48 | 22 | Absent | Increased Contact Resistance Value |
| Comparative example 6 | 0.59 | 10.5 | Absent | Increased Contact Resistance Value |
| Comparative example 7 | 0.56 | 3.2 | Absent | Degraded Bendability |
| Comparative example 8 | 0.55 | 22 | Absent | Increased Contact Resistance Value |
| Conventional example 1 | 0.65 | 120 | Present | |
| Conventional example 2 | 0.43 | 18 | Absent | |

(Note)
Underlined values were measured in a portion outside prescribed range.

<Method for Evaluating Properties of Each Material Under Test>

From each of the plate materials, a material under test was cut, and subjected to the following test. The results of the test were collectively shown in Table 5.

(Measurement of Contact Resistance after Standing at High Temperature)

Each of the materials under test was subjected to a 1000-hour heat treatment at 180° C. Then, the contact resistance thereof was measured by a four-terminal method under conditions such that a release current was 20 mA, a current was 10 mA, and a Au probe was slid. The materials under test each having a contact resistance of less than 10 mΩ after the heat treatment were determined to be acceptable.

(Evaluation of Thermal Separation Resistance after Standing at High Temperature)

Specimens were cut such that the directions in which the specimens were rolled became the longitudinal directions thereof and, using a W-bending test jig defined in JIS H 3110, the specimens were subjected to bending under a load of $9.8\times10^3$N so as to be perpendicular to the rolling direction. Then, a 1000-hour heat treatment at a temperature of 180° C. was performed to the specimens to unbend the bent portions. Thereafter, tape stripping was performed to each of the specimens, and the presence or absence of the separation of the surface plating layer was determined by observing the outer appearance of the stripped portion.

(Bendability)

Specimens were cut such that the directions in which the specimens were rolled became the longitudinal directions thereof and, using a W-bending test jig defined in JIS H 3110, the specimens were subjected to bending under a load of $9.8\times10^3$ N so as to be perpendicular to the rolling direction. Then, cross sections obtained by cutting the specimens by a microtome method were observed. The specimens in which cracks occurred in the bent portions after the test, and propagated to the base materials to cause cracks therein were listed in the column of Degraded Properties of Table 5.

(Solder Wettability)

Assuming reflow soldering for the mounting of an electronic component, 5-minute heating was performed in atmospheric air at 250° C. Then, each of the materials under test was cut into 10 mm×30 mm dimensions so that a direction orthogonal to the rolling direction became the longitudinal direction thereof. Thereafter, each of the materials under test was coated with an inactive flux (α-100 commercially available from Nippon Alpha-Metals Co., Ltd.) by 1-second dipping. For the evaluation of the solder wettability of the material under test, a solder wetting time was measured with a solder checker (SAT-5100 type). The specimen in which the solder wetting time was not less than 3.5 seconds was listed in the column of Degraded Properties of Table 5.

(Coefficient of Dynamic Friction)

Male specimens each having a plate-like shape obtained by simulating the shape of the contact portion of a fitting-type terminal were cut out of materials under test, and fixed to a flat and even stage. Over the male specimens, female specimens obtained by processing the materials under test into hemispherical shapes each having an inner diameter of 1.5 mm were placed to provide contacts between the respective plated surfaces of the male and female specimens. A load (weight load 4) of 3.0 N (310 gf) was placed on each of the female specimens to press the corresponding male specimen and, using a horizontal load meter (Model-2152 commercially available from Aikho Engineering Co., Ltd.), the male specimen was pulled in a horizontal direction (at a sliding speed of 80 mm/min). By measuring a maximum frictional force F till a sliding distance of 5 mm was traveled, a friction coefficient was determined. The specimen in which the coefficient of dynamic friction was not less than 0.6 was listed in the column of Degraded Properties of Table 5.

As shown Table 5, in each of Examples 1 to 5, heat resistance was high (a contact resistance value after standing at a high temperature was low, and thermal separation resistance was also excellent), and there was no degraded property.

In Comparative Example 1 in which the average thickness of a Sn layer was small, the amount of Sn having a corrosion resistant effect was small so that corrosion resistance was low, and solder wettability was also poor. In Comparative Example 2 in which the average thickness of the Sn layer was large, an amount of adhered Sn during insertion increased to increase the friction coefficient.

In Comparative Example 3 in which the average thickness of $Cu_3Sn$ (ε-phase) was small, the effect of inhibiting diffusion of an underlie metal during high-temperature heating was low, and a contact resistance value was large. In Comparative Example 4 in which the average thickness of $Cu_3Sn$ (ε-phase) was large, the thickness of "total Cu—Sn" alloy layers increased so that bendability during the formation of a terminal was poor.

In Comparative Example 5 in which the ratio of $Cu_3Sn$ was high in the ratio between $Cu_3Sn$ (δ-phase) and $Cu_6Sn_5$ (η-phase), Cu was diffused into the surface after high-temperature heating, and the contact resistance value was large. In Comparative Example 6 in which the ratio of $Cu_3Sn$ was high, the effect of preventing diffusion was reduced, and the contact resistance value was also large.

In Comparative Example 8 in which the average thickness of a Ni layer was small, the effect of preventing the diffusion Ni was low so that the contact resistance was high. In Comparative Example 7 in which the average thickness of the Ni layer was large, bendability was poor.

What is claimed is:

1. Sn-plated copper or a Sn-plated copper alloy, comprising:

a base material made of copper or a copper alloy; and a surface plating layer including a Ni layer, a Cu—Sn alloy layer, and a Sn layer which are formed in this order on a surface of the base material, wherein an average thickness of the Ni layer is 0.1 to 1.0 μm, an average thickness of the Cu—Sn alloy layer is 0.55 to 1.0 μm, and an average thickness of the Sn layer is 0.2 to 1.0 μm, said Cu—Sn alloy layer includes Cu—Sn alloy layers having two compositions, and, in said two types of Cu—Sn alloy layers, a portion in contact with the Sn layer is formed of a η-phase having an average thickness of 0.05 to 0.2 μm, and a portion in contact with the Ni layer is formed of an ϵ-phase having an average thickness of 0.5 μm to 0.95 μm.

2. The Sn-plated copper or Sn-plated copper alloy according to claim 1, wherein a ratio between the respective average thicknesses of the Cu—Sn alloy layer formed of said ϵ-phase and the Cu—Sn alloy layer formed of said η-phase is 3:1 to 7:1.

3. The Sn-plated copper or Sn-plated copper alloy according to claim 1, wherein a part of said η-phase is exposed at a surface thereof, and a ratio of a surface exposure area of said η-phase is 20 to 50%.

4. The Sn-plated copper or Sn-plated copper alloy according to claim 1, wherein a ratio among the respective average thicknesses of said Sn layer, the Cu—Sn alloy layer formed of said η-phase, and the Cu—Sn alloy layer formed of said ϵ-phase is 2x to 4x:x:2x to 6x.

5. A manufacturing method of the Sn-plated copper or Sn-plated copper alloy according to claim 1, comprising the steps of:

forming, on the surface of the base material made of the Cu or Cu alloy, a Ni plating layer having an average thickness of 0.1 to 1.0 μm, a Cu—Sn alloy plating layer having an average thickness of 0.4 to 1.0 μm, and a Sn plating layer having an average thickness of 0.6 to 1.0 μm in this order in a direction away from said base material each by electroplating; and then performing a reflow treatment for the Sn plating layer.

6. The manufacturing method of the Sn-plated copper or Sn-plated copper alloy according to claim 5, wherein a Cu plating layer having an average thickness of 0.1 to 0.5 μm is formed between said Cu—Sn alloy plating layer and said Sn plating layer by electroplating.

* * * * *